US005913362A

United States Patent [19]

Jun

[11] Patent Number: 5,913,362

[45] Date of Patent: Jun. 22, 1999

[54] CONDENSER HAVING A COOLANT DISTRIBUTOR

[75] Inventor: Je-hoon Jun, Suwon, Rep. of Korea

[73] Assignee: Samsung Electronics Co., Ltd., Suwon, Rep. of Korea

[21] Appl. No.: 08/969,457

[22] Filed: Nov. 13, 1997

[30] Foreign Application Priority Data

Jan. 20, 1997 [KR] Rep. of Korea ..... 97-1524

[51] Int. Cl.[6] ..... F28D 1/06

[52] U.S. Cl. ..... 165/132; 165/110; 165/174; 62/509

[58] Field of Search ..... 165/132, 174, 165/110; 62/509

[56] References Cited

U.S. PATENT DOCUMENTS

| | | | |
|---|---|---|---|
| 4,309,987 | 1/1982 | Higgins, Jr. | 165/174 |
| 5,159,821 | 11/1992 | Nakamura | 165/132 |
| 5,331,827 | 7/1994 | Chlebak | 62/509 |
| 5,379,833 | 1/1995 | Mathews | 165/132 |
| 5,415,014 | 5/1995 | Waldschmidt et al. | 62/509 |
| 5,546,761 | 8/1996 | Matsuo et al. | 62/509 |
| 5,582,027 | 12/1996 | Baba et al. | 62/509 |
| 5,592,830 | 1/1997 | Baba et al. | 165/132 |

*Primary Examiner*—Ira S. Lazarus
*Assistant Examiner*—Terrell McKinnon
*Attorney, Agent, or Firm*—Burns, Doane, Swecker & Mathis, L.L.P.

[57] ABSTRACT

A condenser which includes a coolant dispensing section which uniformly dispenses a coolant of high temperature compressed by the compressor, a body which is heat-exchanged with air while the coolant is circulating, and an exit tube which discharges the coolant heat-exchanged with the body. The coolant dispensing section includes a dispenser which uniformly dispenses the coolant, a coolant pipe which connects the compressor and an upper portion of the dispenser, and coolant supply tubes which supply the coolant into the body from the dispenser. The coolant supply tubes are protruded from a side wall of the dispenser by predetermined distances, and end portions of the coolant supply tubes are obliquely cut-away. When the coolant falls toward the bottom of the dispenser from the upper portion of the dispenser, it is introduced into the body through the coolant supply tubes. The coolant is cooled in the body by heat-exchange with the air. According to the present invention, the coolant can be uniformly introduced into the body through the coolant supply tubes, and loads and noises generated in the compressor can be decreased, and thus the heat-exchange efficiency of the overall air conditioning system can be effectively improved.

8 Claims, 4 Drawing Sheets

CONDENSER HAVING A COOLANT DISTRIBUTOR

BACKGROUND OF THE INVENTION

1. Field of the Invention

The present invention relates to a heat-exchanger, and more particularly to a condenser which condenses a coolant of high temperature and high pressure.

2. Description of the Prior Art

FIG. 1 schematically shows a closed air conditioning system such as a refrigerator and an air conditioner or the like. When the coolant circulates in a closed passage of the air conditioning system 10, it is compressed or expanded to exchange heat with an air.

Referring to FIG. 1, the air conditioning system includes an evaporator 12 for generating cooling air, a compressor 14 which is connected to the evaporator 12 and compresses a coolant, a condenser 20 which condenses the coolant from the compressor 14, and an expansion valve 18. The evaporator 12 generates the cooling air when the coolant is heat-exchanged with air. The coolant compressed by the compressor 14, which is of high temperature, is heat-exchanged with the air by the condenser 20 to be cooled. Fan 15 forcibly flows the air in a conduit (not shown) to effectively accomplish the heat-exchange between the evaporator 12 and the condenser 20.

FIG. 2 shows a conventional condenser 20. Referring to FIG. 2, the condenser 20 includes a body in which a coolant of high temperature and high pressure is flowed and is heat-exchanged with air, a coolant supply section 26 which supplies the coolant into the body 22, and an exit tube 24 through which the coolant heat-exchanged in the body 22 is discharged. The coolant supply section 26 is connected to the compressor 14, which compresses the coolant, through a coolant pipe 16 and is supplied with the coolant from the compressor 14.

The coolant supply section 26 includes a dispenser 28 which dispenses the coolant supplied from the compressor 14 through the coolant pipe 16 connected to the bottom surface thereof, and coolant supply tubes 30U, 30L which are connected to a side wall of the dispenser 28 to supply the coolant in the dispenser 28 into the body 2. The coolant is introduced via the coolant pipe 16 connected to the bottom surface of the dispenser 28 to the dispenser 28. The coolant supply tubes 30U, 30L which communicates the dispenser 28 with the body 22, are respectively connected to upper and lower positions of the side wall of the dispenser 28.

The coolant flowing into the dispenser 16 via the coolant pipe 28 is supplied into the interior of the body 22 through the upper and lower coolant supply tubes 30U, 30L. In the dispenser 28, the location of the coolant surface needs to be higher than that of the upper coolant supply tube 30U in order to supply the coolant into the body 22 therethrough. However, if the pressure generated by the compressor 14 is low, the level of the coolant becomes low, and so the amount of coolant introduced through the upper coolant supply tube 30U becomes smaller than the amount of coolant introduced through the lower coolant supply tube 30L, which lowers the heat-exchange efficiency of the condenser 20.

Therefore, the pressure generated by the compressor 14 should be higher than a predetermined value. However, much electric power is needed to increase the pressure, and severe noises are generated by the high pressure.

SUMMARY OF THE INVENTION

Therefore, it is an object of the present invention to provide a condenser in which a coolant can be uniformly supplied, and loads and noises generated in the compressor can be decreased, and thus the heat-exchange efficiency can be effectively improved.

In order to accomplish the above-mentioned object of the present invention, a condenser according to the present invention comprises a coolant dispensing section into which a coolant of high temperature compressed by a compressor is introduced at an upper portion thereof, a body in which the coolant is heat-exchanged, and an exit tube through the coolant in the body is discharged.

The coolant dispensing section comprises a dispenser into which a coolant of high temperature is introduced by a compressor at an upper portion thereof, a coolant pipe for connecting the compressor to the upper portion of the dispenser, a first coolant tube connected to an upper portion of a side wall of the dispenser for discharging the coolant, and a second coolant supply tube connected to a lower portion of the side wall of the dispenser for discharging the coolant.

The first and second coolant supply tubes are protruded from the side wall of the dispenser by first and second distances, respectively. One end portion of each of the first and second coolant supply tubes is obliquely cut-away so as to have an elliptic crosssection.

The coolant is uniformly introduced into the first and second coolant supply tubes when it falls toward the bottom of the dispenser. The coolant is then supplied into the body and is heat-exchanged with the air, and then is discharged outside the body through the exit tube.

According to the condenser of the present invention, the coolant can be uniformly supplied into the condenser, and the heat-exchange is improved. Further, the system in which the condenser can be silently operated.

BRIEF DESCRIPTION OF THE DRAWINGS

The above objects and other advantages of the present invention will become more apparent by describing in detail a preferred embodiment thereof with reference to the attached drawings, in which.

DETAILED DESCRIPTION OF THE PREFERRED EMBODIMENT

Hereinafter, a preferred embodiment of the present invention will be described in detail with reference to the accompanying drawings.

Figure 3:
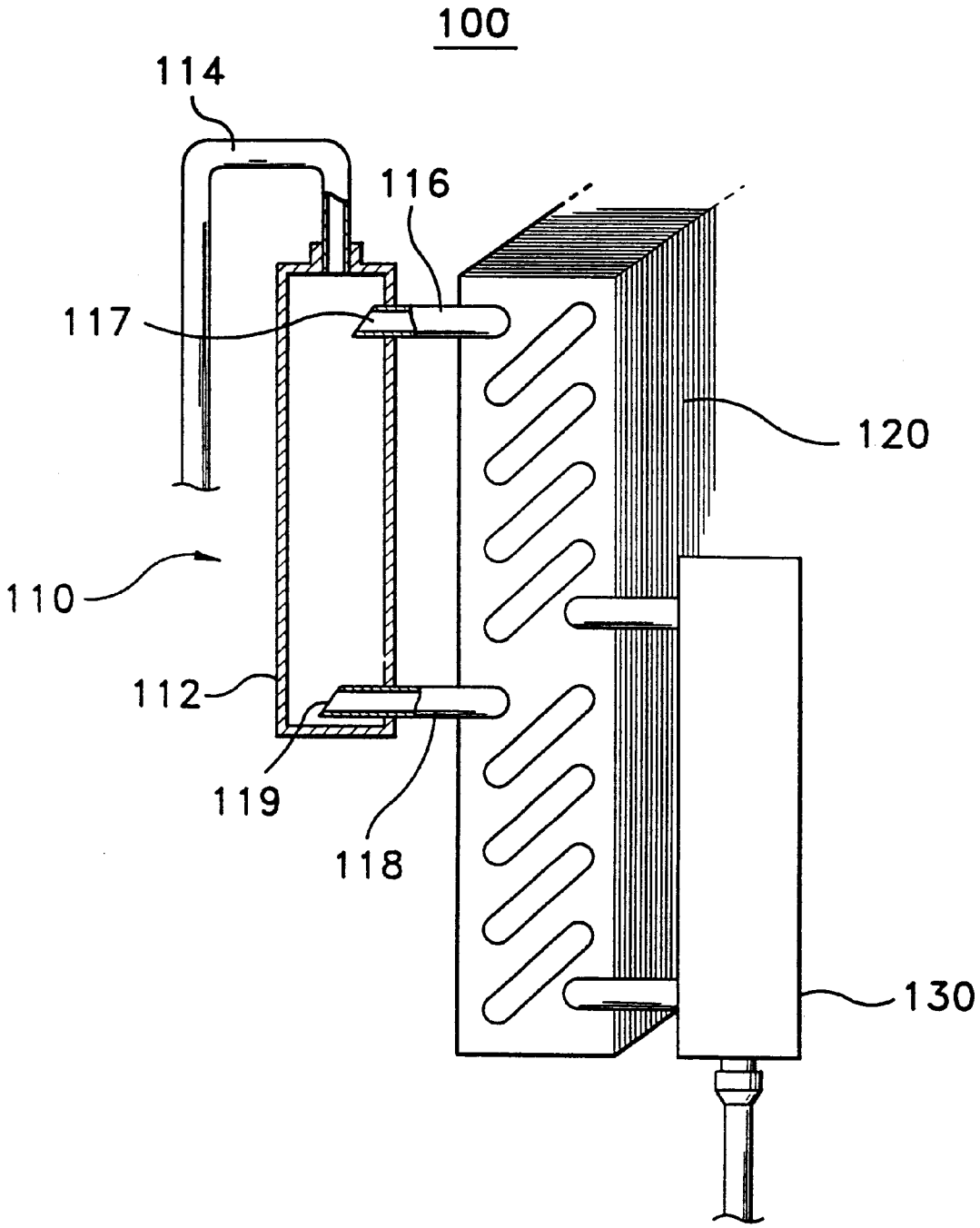
FIG. 3 is a partially cut-away perspective view for showing a condenser according to a preferred embodiment of the present invention.

FIG. 3 shows a condenser 100 according to a preferred embodiment of the present invention. Referring to FIG. 3, the condenser 100 includes a coolant dispensing section 110 which is connected to a compressor (not shown), a body 120 which is supplied with a coolant from the coolant dispensing section 110, and in which the coolant is heat-exchanged, and a coolant exit tube 130.

As shown in the figure, the coolant dispensing section 110 includes a dispenser 112 into which the coolant of high temperature is supplied from the compressor, a coolant pipe 114 which is connected to a coolant inlet disposed at a first portion at an upper portion of the dispenser 112, and through which the coolant is introduced by the compressor, a first or upper coolant supply tube 116 which connects the body 120 to an upper portion of a side wall of the dispenser 112 at a second location disposed lower than the first location and a second or lower coolant supply tube 118 which connects the body 120 to a lower portion of the side wall of the dispenser 112 at a third location disposed lower than the first and second locations.

The coolant introduced by the compressor into the interior of the dispenser 112 via the coolant pipe 114 falls toward the bottom of the dispenser 112 from one end of the coolant pipe 114. Then, the coolant is introduced into the body 120, partly through the first coolant supply tube 116 and partly through the second coolant supply tube 118 connected to the lower portion of the side wall of the dispenser 112.

The dispenser 112 temporarily stores the coolant introduced thereinto through the coolant pipe 114 which is connected to an upper portion thereof, preferably to the upper surface thereof. The first and second coolant supply tubes 116 and 118 are respectively penetrated through the side wall of the dispenser 112 and thus connected to the dispenser 112. The first coolant supply tube 116 is connected the dispenser 112 so as to be protruded by a first distance from the side wall of the dispenser 112, and the second coolant supply tube 118 is connected the dispenser 112 so as to be protruded by a second distance from the side wall of the dispenser 112.

Figure 4:
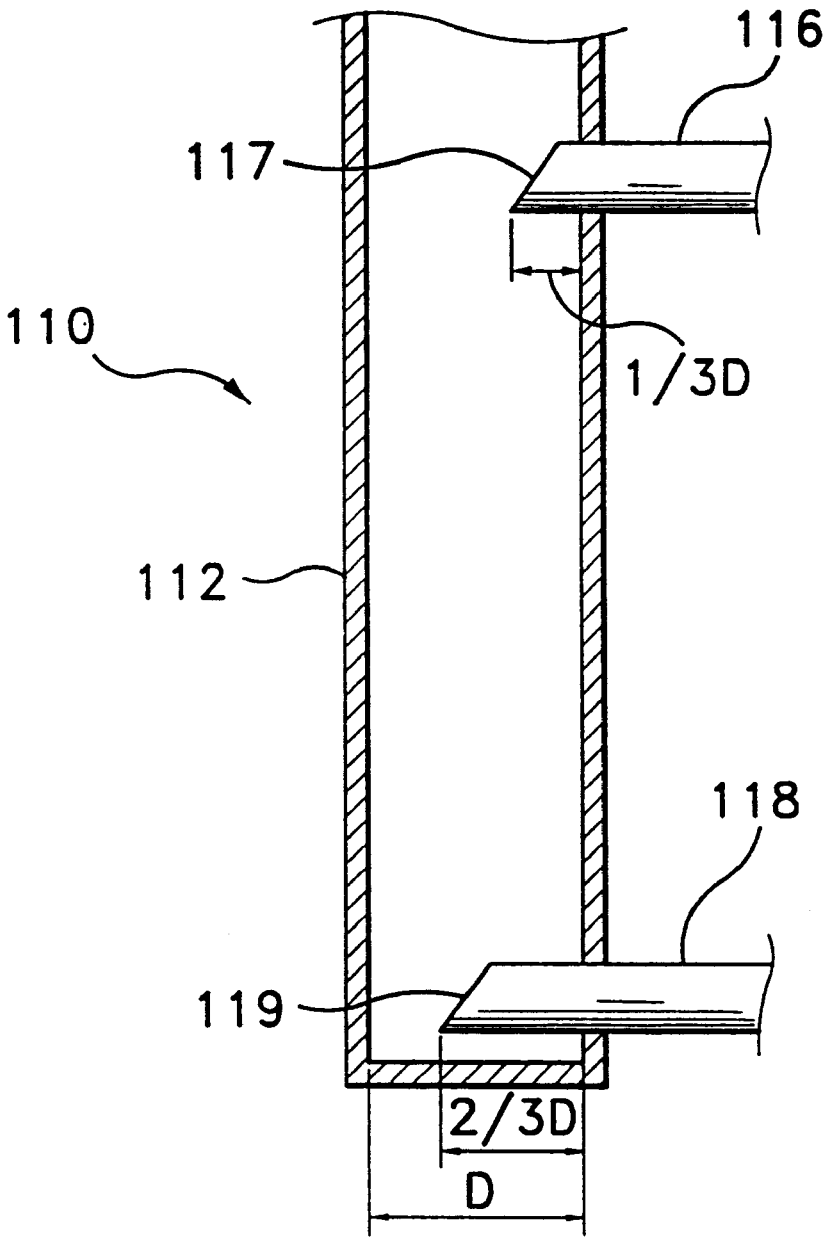
FIG. 4 is an enlarged sectional view for showing a portion of the condenser of FIG. 3.

FIG. 4 shows in detail the connections between the dispenser 112 and the first and second coolant supply tubes 116 and 118. As shown in FIG. 4, the first and second coolant supply tubes 116 and 119 respectively have first and second end portions 117 and 118 of elliptic cross-sections. The first and second end portions 117 and 119 is formed by obliquely cutting away end portions of the first and second coolant supply tubes 116 and 118. By the elliptic cross-sections of the first and second coolant supply tubes 116 and 118, the contact areas of the end portions with the coolant are enlarged, so the coolant is easily introduced into the first and second coolant supply tubes 116 and 118 during the falling.

The first and second coolant supply tubes 116 and 118 is protruded from the side wall of the dispenser 112 by the first and second distances. When the distance between the side walls of the dispenser 112 is D, it is preferable that the first distance is determined to be substantially one third of D, and the second distance substantially two third of D. The protrusions of the first and second coolant supply tubes 116 and 118 from the side wall of the dispenser 112 facilitates the introduction of the coolant 112 into the first and second coolant supply tubes 116 and 118.

Hereinafter, the operation of the condenser 100 according to the preferred embodiment of the present invention will be explained.

Figure 1:
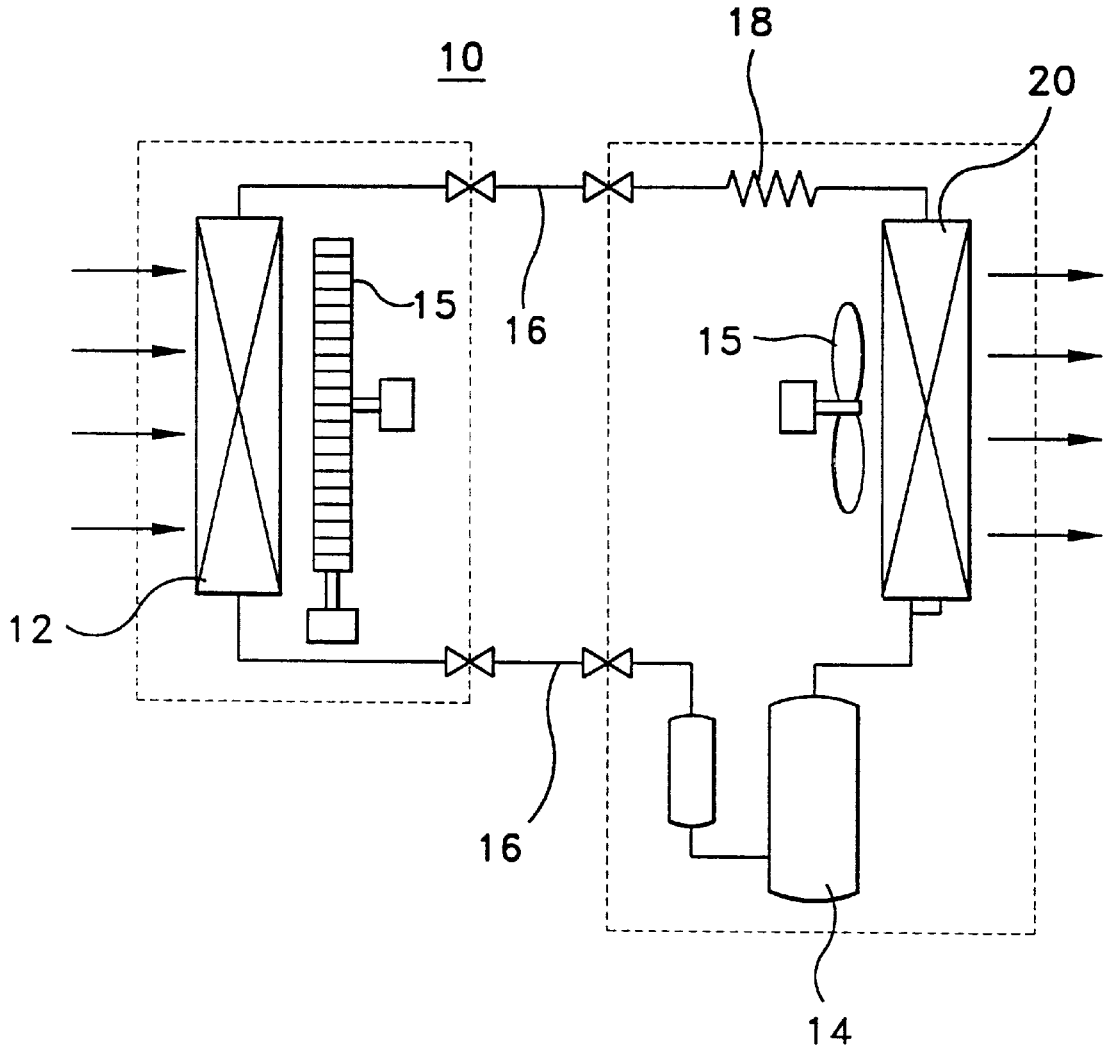
FIG. 1 (PRIOR ART)
FIG. 1 is a schematic view for showing a conventional air conditioning system.
Figure 2:
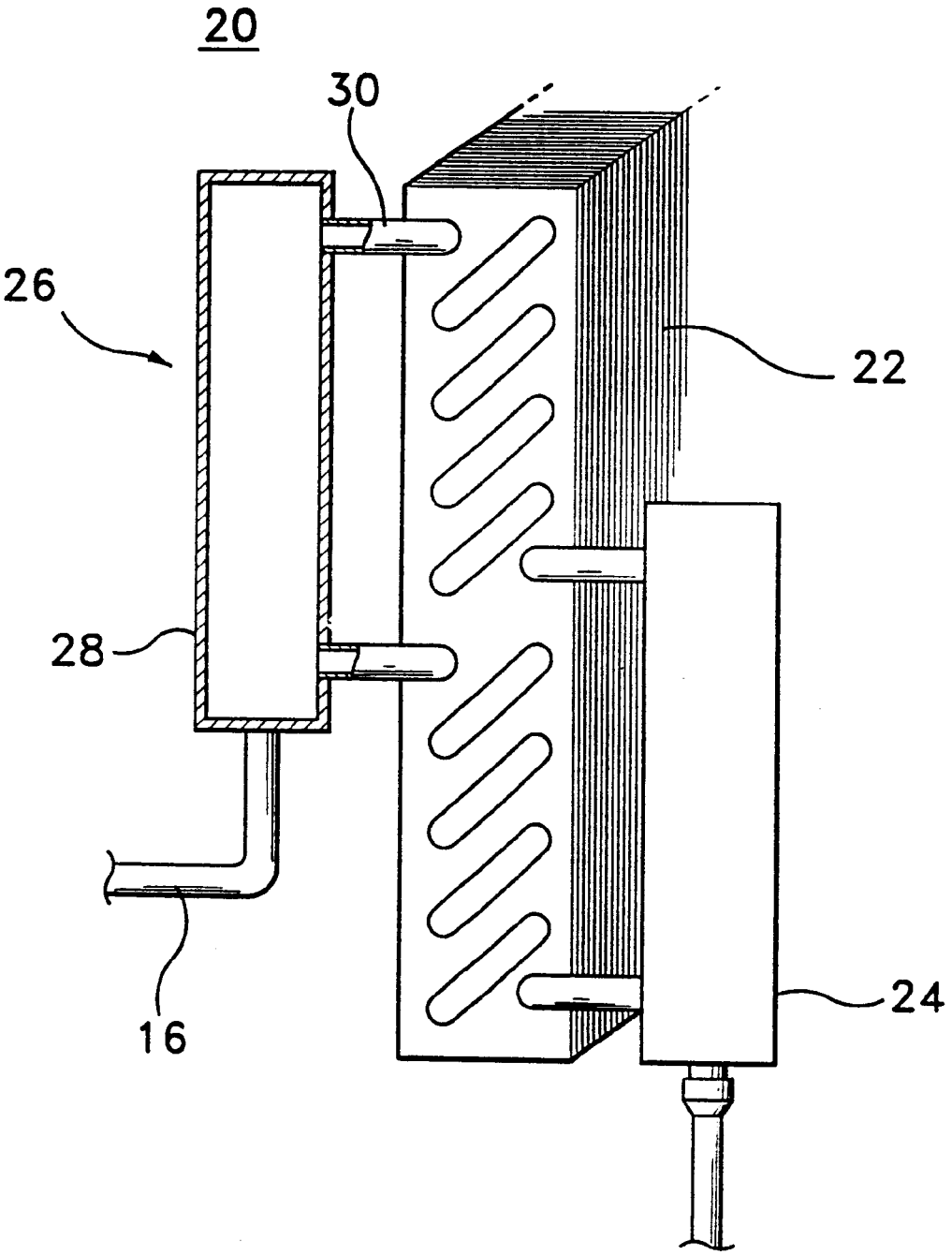
FIG.2 (PRIOR ART)
FIG. 2 is a partially cut-away perspective view for showing a condenser employed in the air conditioning system of FIG. 1.

Referring to FIGS. 1 and 3, when an electric power is applied to an air conditioning system, the compressor 14 compresses the coolant. The compressed coolant of high temperature is introduced into the dispenser 112 at the upper portion thereof by the compressor 14 via the coolant pipe 114, and then falls toward the bottom of the dispenser 112. Then, the coolant is introduced, partly through the first end portion 117 into the first coolant supply tube 116 and partly through the second end portion into the second coolant supply tube 118.

The coolant is then introduced into the body 112 through the first and second coolant supply tubes 116 and 118 and is heat-exchanged with air. So, the coolant can be uniformly introduced into the body 122 through the first and second coolant supply tubes 116 and 118 even in case the level of the coolant in the dispenser 112 is lower than a predetermined value.

The heat-exchanged coolant in the compressor 100 is expanded in an expansion valve 18 and is introduced into an evaporator 12. The evaporator 12 generates cooling air by the heat-exchange between the coolant and the air, and the temperature of the coolant is increased. The coolant of high temperature is compressed by the compressor, and then is introduced into the compressor 14.

According to the present invention, the coolant can be uniformly introduced into the body through the coolant supply tubes, and loads and noises generated in the compressor can be decreased, and thus the heat-exchange efficiency of the overall air conditioning system can be effectively improved.

While the present invention has been particularly shown and described with reference to a particular embodiment thereof, it will be understood by those skilled in the art that various changes in form and details may be effected therein without departing from the spirit and scope of the invention as defined by the appended claims.

What is claimed is:

1. A condenser comprising:

a coolant dispensing section having a dispenser, the dispenser including a coolant inlet disposed at a first location and into which a coolant of high temperature from a compressor is introduced, a coolant pipe for connecting the compressor to the coolant inlet of the dispenser, an upper coolant supply tube connected to a side wall of the dispenser at a second location lower than the first location for discharging the coolant, and a lower coolant supply tube connected to the side wall of the dispenser at a third location lower than the first and second locations for discharging the coolant;

a body into which the coolant is introduced from the upper and lower coolant supply tubes, and in which the coolant is heat-exchanged with air; and a coolant exit tube for discharging the heat-exchanged coolant from the body.

2. A condenser according to claim 1, wherein the upper coolant supply tube protrudes from the side wall and into the dispenser by a first distance.

3. A condenser according to claim 2, wherein the side wall constitutes a first side wall, the first distance being substantially one third of a distance between the first side wall and a second side wall opposed to the first side wall.

4. A condenser according to claim 1, wherein an inner end of the upper coolant supply tube extends through the side wall and into the dispenser and is obliquely cut-away so as to have an elliptic cross-section.

5. A condenser according to claim 2, wherein the lower coolant supply tube protrudes from the side wall and into the dispenser by a second distance.

6. A condenser according to claim 5, wherein the second distance is substantially two thirds of the distance between the first and second side walls.

7. A condenser according to claim 4, wherein an inner end of the lower coolant supply tube extends through the side wall and into the dispenser and is obliquely cut-away so as to have an elliptic cross-section.

8. A condenser according to claim 1 wherein the first location is disposed in a top wall of the distributor, whereby the coolant is introduced in a downward direction into the distributor.

* * * * *